United States Patent [19]

Douglas

[11] 4,226,383

[45] Oct. 7, 1980

[54] SUPPORT DEVICE AND FLANGE ATTACHMENT MEANS FOR CABLE DRUMS

[75] Inventor: Homer C. Douglas, Kansas City, Kans.

[73] Assignee: Cable Caddy, Inc., Lenexa, Kans.

[21] Appl. No.: 45,125

[22] Filed: Jun. 4, 1979

Related U.S. Application Data

[62] Division of Ser. No. 861,108, Dec. 16, 1977, Pat. No. 4,176,801.

[51] Int. Cl.[3] ..... B65H 75/14

[52] U.S. Cl. ..... 242/77; 242/118.6

[58] Field of Search ..... 242/118.4, 118.61, 118.62, 242/118.6, 94, 77, 77.4, 54 R, 118.7; 206/402, 407, 415, 416

[56] References Cited

U.S. PATENT DOCUMENTS

| | | | |
|---|---|---|---|
| 1,726,137 | 8/1929 | Bernal | 242/94 X |
| 1,733,598 | 10/1929 | Hubbard | 242/118.4 X |
| 3,009,367 | 11/1961 | Browne | 242/94 |
| 3,152,772 | 10/1964 | Schjerven | 242/94 |
| 3,388,877 | 6/1968 | Laven et al. | 242/118.4 |

FOREIGN PATENT DOCUMENTS

| | | | |
|---|---|---|---|
| 27015 | of 1907 | United Kingdom | 242/118.62 |

*Primary Examiner*—George F. Mautz

*Attorney, Agent, or Firm*—Lowe, Kokjer, Kircher, Wharton & Bowman

[57] ABSTRACT

A device for rotatably supporting a drum or reel of the type on which cable is wound. The vertical flanges of respective angle members are spaced apart to receive therebetween the circular end flange of the cable drum. The drum flange is supported on roller bearings mounted between the angle members. An arcuate cut-out is formed in the vertical flange of one angle in order to accommodate the outer layer of cable when the drum is full or nearly full. The invention also provides a toggle type mechanism used to add an undamaged circular flange onto the damaged flange of a cable drum. The toggle mechanism extends from the undamaged flange and may be expanded after having been passed through the central opening of the damaged flange. Expansion of the connector rigidly holds the undamaged flange on the end of the drum, with a spacer disc acting to maintain the flanges apart from one another.

7 Claims, 8 Drawing Figures

SUPPORT DEVICE AND FLANGE ATTACHMENT MEANS FOR CABLE DRUMS

This is a division of application Ser. No. 861,108, filed Dec. 16, 1977, now U.S. Pat. No. 4,176,801.

BACKGROUND AND SUMMARY OF THE INVENTION

This invention relates to a device for rotatably supporting drums such as those containing wound cable, and also to a mechanism that serves to add an undamaged circular flange to a drum of this type.

In order to permit cable such as telephone cable and the like to be drawn off of the drums or reels on which it is wound, various types of devices have been developed to rotatably support the cable drum during pay out of the cable. However, for the most part, such devices have not met with widespread acceptance by workers engaged in handling the cable drums. Often, upright stands are spaced apart on opposite ends of the drum and a shaft is extended through the core of the drum and received by the stands at its opposite ends in order to locate the drum above the ground. As can be easily appreciated, devices of this nature are complex and costly and are difficult and time consuming to set up and take down. Consequently, the entire operation is delayed considerably and the costs are likewise increased. Another disadvantage of this type of device is that it permits the drum to "freewheel" or rotate excessively.

Other types of support arrangements for the cable drums include rollers on which the circular flanges at the opposite ends of the drum are received in a manner to rotate as the cable is drawn off of the drum. These devices suffer from the same drawbacks in respect to cost and complexity and are further characterized by excessive size and weight and difficulty of maintenance and repair. Typically, as exemplified by the United States patents to Misrach U.S. Pat. No. 3,743,205, Petersen et al U.S. Pat. No. 2,958,478 and Turner et al U.S. Pat. No. 2,904,273, this type of structure includes rollers that extend the entire length of the drum or longer, despite the fact that they engage only the end flanges. Therefore, the portions of the support rollers located between the drum flanges serve no useful purpose.

In addition, the devices known in the prior art are difficult to handle and occupy a large area when stored or when carried from place to place, as in a truck bed. Since drums such as those used in the telephone industry are frequently carried back and forth between the locations at which the cable is required, these latter drawbacks unduly burden telephone crews and significantly delay completion of their work.

Perhaps even more importantly, the center of gravity of the drum is relatively high when it is positioned on the existing support devices, and the stability of the drum is thus lacking, sometimes leading to accidents and other unsafe conditions. Morever, the drum supports that have been proposed in the past are not able to accommodate drums that are completely or nearly completely filled with cable, or to handle drums that vary significantly in size.

A related problem that arises frequently in connection with the use of cable drums of this type is the susceptibility of the end flanges to damage. The drums are usually constructed of wood and they are often treated roughly; for example, it is typical for them to be repeatedly dropped to the ground from trucks and other vehicles. As a result, the circular end flanges are often broken or otherwise severely damaged on their edges. This in turn makes the drum roll unevenly and sometimes not at all on the rollers that support it when the cable is payed out. Therefore, the drum must be discarded even though it would still be useful for a considerable period of time were it not for the broken flange.

In view of the foregoing problems and difficulties, a need remains for an improved support unit for cable drums and also for a means to prolong the life of the drum after one or both of its end flanges have been damaged. The present invention is aimed primarily at meeting these needs.

More specifically, it is an object of the invention to provide a cable drum support unit which is lightweight, small and easy to handle, quick and easy to set up and take down, and which is able to readily accommodate drums that vary in size. Unlike the prior art devices, the device provided by this invention includes only a minimum number of small roller bearings and structural angles that are only as large as necessary. Furthermore, the device is extremely light and is provided with a handle by which it may be easily carried from place to place or thrown into a truck bed.

Another object of the invention is to provide a drum support unit of the character described that is specially constructed in a manner to handle cable drums that are substantially completely filled with cable. In this regard, the arcuate cutout formed in the angle member of each unit is important in that it provides adequate space for accommodating the outer layer of cable when the drum is full.

In conjunction with the preceding object, it is still another object of the invention to provide a drum support unit of the character described which maintains the drum as low as possible in order to maximize its stability. Again, the arcuate cutout is significant because it provides for a lower center of gravity while accommodating a full drum.

A further object of the invention is to provide a drum support unit of the character described which is simple and economical to construct and which is virtually maintenance free over a long useful life.

An additional object of the invention is to provide a unique mechanism by means of which an undamaged circular end flange may be easily added onto a drum in order to substitute for a damaged flange. In this respect, it is important to the invention that the added flange is located such that it is able to cooperate with drum support rollers of various types without requiring any significant modification or adjustment of the roller structure.

Yet another object of the invention is to provide a mechanism of the character described which may be quickly and easily attached and which securely mounts the added flange closely to but spaced from the damaged flange.

A still further object of the invention is to provide a mechanism of the character described which is adapted for use with various types and sizes of drums.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views.

Figure 1:
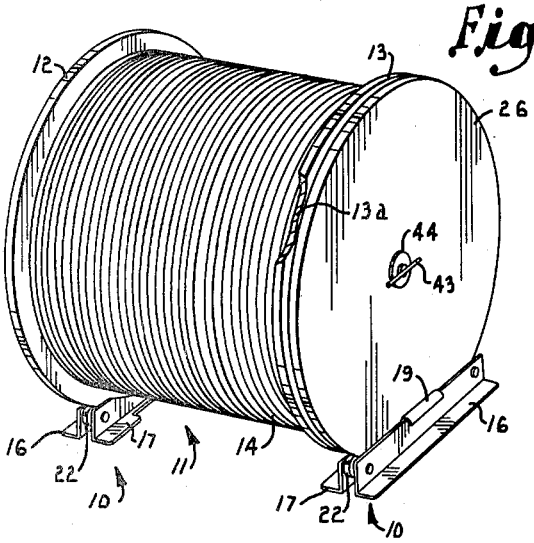
FIG. 1 is a perspective view of a cable drum to which an undamaged flange has been added and which is positioned on a pair of drum support units constructed according to the present invention.
Figure 2:
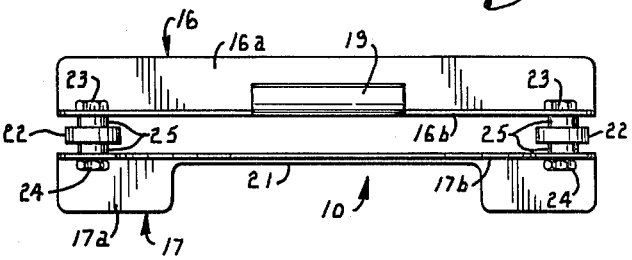
FIG. 2 is a top plan view of one of the drum support units shown in FIG. 1.
Figure 3:
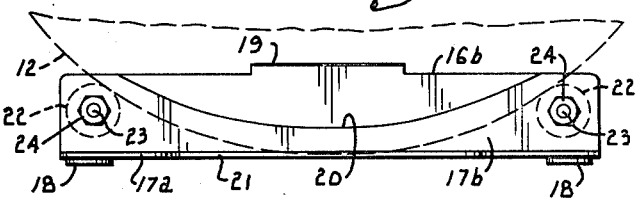
FIG. 3 is a side elevational view of one of the drum support units, with the drum flange shown in broken lines.

Referring now to the drawing in detail and initially to FIGS. 1—3, numeral 10 generally designates a drum support device constructed in accordance with a preferred embodiment of the present invention. A pair of the devices 10 are used to rotatably support a drum or reel such as the generally cylindrical cable drum 11 shown in FIG. 1. The drum 11 has a pair of circular end rims or flanges 12 and 13 between which a central tubular core (not shown) extends. Cable 14 is wound in the usual manner around the core between the flanges 12 and 13.

Each drum support device 10 includes a pair of angle members 16 and 17 which are preferably constructed of aluminum in order to minimize their weight. Members 16 and 17 have flat, horizontal base flanges 16*a* and 17*a*, respectively, which are plate-like members able to rest on the ground or other supporting surface. Each base flange 16*a* and 17*a* has a pair of rubber pads 18 secured to its underside to prevent it from sliding on the supporting surface. Respective plate-like vertical flanges 16*b* and 17*b* of the angle members are spaced apart from one another a distance somewhat greater than the thickness of the end flanges 12 and 13 of the cable drum. A curved handle 19 is formed integrally on the upper edge of flange 16*b* in outward projection therefrom to facilitate the carrying and handling of the device.

As best shown in FIG. 3, a central portion of flange 17*b* is cut away in arcuate fashion to provide an open cutout area 20 bounded by an arcuate edge. The cutout 20 extends downwardly over half the height of flange 17*b* and has a length somewhat less than the flange length. With reference now to FIG. 2 in particular, a rectangular cutout 21 is formed in flange 17*a* at a central location thereon, for a purpose that will be made clear. Cutout 21 extends well over half the length of member 17.

A pair of roller bearings 22 are rotatively supported between flanges 16*b* and 17*b* at locations near the opposite ends of the angle members 16 and 17. Rollers 22 are mounted to rotate on horizontal bolts 23 which extend through openings in flanges 16*b* and 17*b* and which are secured by nuts 24. Spacer elements 25 are fit on the bolt on opposite sides of each roller to center the same between flanges 16*b* and 17*b* while spacing the rollers away from the flanges.

In use, a pair of the drum support devices 10 are spaced apart from one another a distance equal to the length of drum 11. Flanges 16*a* and 17*a*, in cooperation with the non-sliding pads 18, provide a flat stable base for supporting the devices in place on the ground or other surface. The drum flanges 12 and 13 are positioned on the rollers 22 of devices 10, thereby supporting the drum such that it is able to freely rotate as the cable 14 is drawn off of it.

It is to be noted, as best shown in FIG. 3, that the lower edges of flanges 12 and 13 are located barely above the ground when the drum is installed on the support units. A lower center of gravity thus results and instability and other safety hazards are avoided. It is to be noted further that the arcuate cutout 20 accommodates drums that are nearly completely filled such that the outer layer of cable extends nearly to the outer edges of flanges 12 and 13. Without cutouts 20, the outer layer or layers of cable would engage flange 17*b*, and the device could not be used with drums that are full or nearly full of cable. Cutouts 20 thus greatly increase the utility of the device, particularly in connection with relatively small telephone cable which is often wound fully onto the drum. The purpose of cutout 21 will become clear as the description of the invention proceeds.

Referring now more particularly to FIGS. 4–8, the present invention deals also with the attachment of an undamaged circular flange 26 to drum 11 in the event that one of the flanges 12 or 13 becomes damaged, as indicated by the broken edge portion 13*a* of flange 13. When damage to the original flanges occurs, the drum does not roll properly on any type of support unit. At present, drums having damaged flanges are discarded even though they would still be useful except for the broken flange.

In accordance with the present invention, a circular spacing disc 27 has integral, reduced diameter hub portions 28 and 29 projecting from its opposite sides. Hub 28 is fit closely in a circular opening 30 formed centrally in flange 26, and disc 27 is secured flatly against the inside surface of flange 26, as by screws 31 (FIG. 5).

The opposite hub 29 carries an expansible and contractable connector head which is generally identified by reference numeral 32 and which is a toggle type mechanism. A mounting block 33 is connected to the inner surface of hub 29 by screws 34 (see FIG. 7). Disc 27, hubs 28 and 29, and block 33 are centrally bored as indicated at 35. Block 33 is provided with a pair of aligned slots in which short links 37 are received and pinned at one end. The opposite ends of links 37 are pivoted in slots formed in a pair of levers 38 which carry a block 39 in extension between their outer ends. Block 29 is pivoted to the levers and has a central threaded opening 40 aligned with bore 35. Levers 38 have beveled base ends terminating in relatively sharp edges that serve a purpose to be explained hereinafter.

Figure 5:
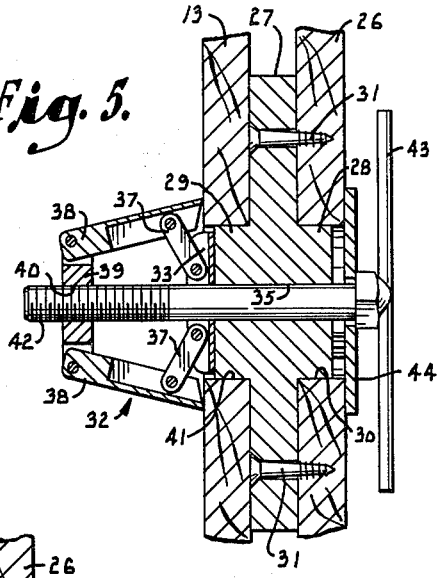
FIG. 5 is a fragmentary sectional view on an enlarged scale taken generally along line 5—5 of FIG. 4 in the direction of the arrows, with the connector head in its expanded condition to hold the undamaged flange on the drum.
Figure 6:
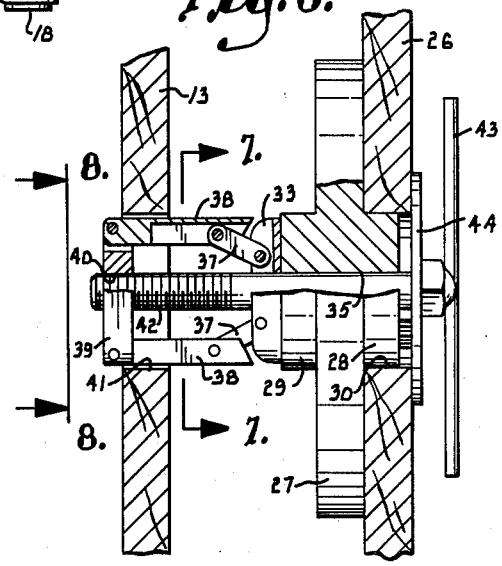
FIG. 6 is a fragmentary, partially sectional view similar to FIG. 5 but showing the connector head in the contracted position as it is applied to the damaged flange.
Figure 7:
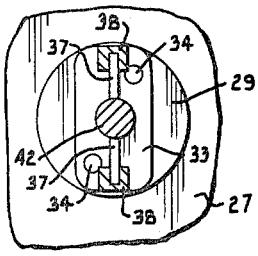
FIG. 7 is a fragmentary sectional view taken generally along line 7—7 of FIG. 6 in the direction of the arrows.
Figure 8:
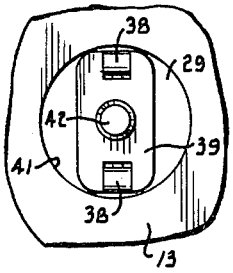
FIG. 8 is a fragmentary elevated view taken generally along line 8—8 of FIG. 6 in the direction of the arrows.

The links 37 and levers 38 cooperate with one another to provide a toggle mechanism which shifts between the expanded position shown in FIG. 5 and the contracted position shown in FIG. 6 by toggle action. In the contracted position, wherein the toggle legs are relatively straight, connector head 32 is small enough to pass through the central opening 41 of the damaged flange 13. The connector head 32 is too large to pass back through opening 41 when in the expanded position shown in FIG. 5, wherein the toggle legs are bent.

Expansion and contraction of the connector head is effected by an elongate bolt 42 which is threaded on its end portion in order to mate with the internal threads of opening 40. A hand lever 43 is welded to the head of bolt 42, while a large washer 44 is preferably used with the bolt to contact the outer surface of flange 26.

When the undamaged flange 26 is to be attached to the damaged flange 13, bolt 42 is inserted through bore 35 and threaded barely through opening 40. When lever 43 is then pushed against flange 26, the toggle type connector head 32 is held in the contracted position (FIG. 6). The connector head is then inserted through opening 41 until hub 29 is received in the opening and the spacing disc 27 flatly engages the surface of flange 13, at which time the base ends of levers 38 are located inwardly of the inside surface of flange 13. It is noted that the hollow tubular core (not shown) of drum 11 is larger than opening 41 and that the inside surface of flange 13 within the core is inaccessible.

After connector head 32 has thus been inserted through opening 41, it is expanded by threading bolt 42 into opening 40, thereby drawing block 39 toward the bolt head. Due to the toggle arrangement of links 37 and levers 38, such movement of plate 39 causes the base ends of levers 37 to move outwardly as links 27 pivot about their connections with the levers and with block 33. Consequently, the base ends of levers 37 and particularly the edges thereof are drawn firmly against the inside surface of flange 13 outwardly of opening 41. When bolt 42 is fully tightened by means of the hand lever 43, the expanded connector head 32 acts to firmly lock flange 36 in position spaced outwardly of and parallel to flange 13 and centered on the drum axis. In the locked condition, hubs 28 and 29 prevent any wobbling or misalignment of flange 26, while disengagement of connector head 32 from flange 13 is precluded due to the large size of the expanded connector head and also due to the biting action of the edges of levers 38 against the inside flange surface.

Figure 4:
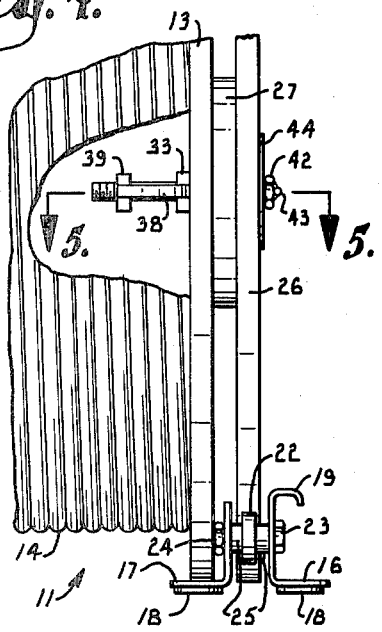
FIG. 4 is a fragmentary end elevational view of one of the drum support units and showing the undamaged drum flange received thereon, with a portion of the drum broken away for purposes of illustration.

Flange 26 is thus rigidly connected to flange 13 in order to provide a smooth rolling action when the drum is installed on cable drum supports such as the devices 10 shown in FIG. 1. It is noted that disc 27 spaces flange 26 outwardly of flange 13 in order to locate the damaged drum flange inwardly of the plate-like flange **17*b*, as best shown in FIG. 4. Accordingly, the damaged flange 13 does not interfere with the rolling action of drum 11** as the cable is payed out.

The rectangular cutout 21 formed in angle member 17 permits drum 11 to be as low as possible without the damaged flange 13 contacting the base flange **17*a* of member 17. As best shown in FIG. 3, drum 11 can be low enough that flange 13 barely clears the ground since the edge of the flange passes through cutout 21 without contacting the base flange 17*a***.

Flange 26 can be removed simply by loosening bolt 42. When the bolt is loosened sufficiently, lever 43 can be pressed toward flange 26 to move the connector head 32 to the contracted position shown in FIG. 6. Flange 26 can then simply be pulled outwardly such that the contracted connector head passes back through opening 41, thereby removing flange 26 from the cable drum 11.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus adapted for attachment to a drum having a damaged flange on one end thereof, with the damaged flange presenting a substantially central opening therein and an inaccessible inner surface surrounding the opening, said apparatus comprising:

an undamaged flange presenting a generally circular periphery and substantially equal in size to the damaged flange;

an expansible and contractable connector device having a contracted position wherein said device is small enough to pass through the central opening of the damaged flange, and an expanded position wherein said device is too large to pass through the central opening;

means coupling said connector device with said undamaged flange whereby said connector device may be inserted through the central opening of the damaged flange to position the damaged and undamaged flanges in proximity to one another; and means operable from the side of said undamaged flange remote from the damaged flange to effect movement of said connector device from the contracted position to the expanded position.

2. Apparatus as set forth in claim 1, including a spacer element connected with said connector device and adapted to be sandwiched between the damaged and undamaged flanges in a manner to space the same apart from one another a preselected distance.

3. Apparatus as set forth in claim 2, including a substantially central opening in said undamaged flange and means connected with said spacer element and fitting closely in the central openings of the damaged and undamaged flanges.

4. Apparatus as set forth in claim 1, wherein said connector device is constructed in a manner to move by toggle action between the contracted and expanded positions,

5. A device for connecting a substantially circular undamaged flange to a drum having a damaged flange which presents an opening therein and an inaccessible inner surface surrounding the opening, said device comprising:

an expansible and contractable connector mechanism having a contracted position wherein said mechanism is small enough to pass through the opening of the damaged flange, and an expanded position wherein said mechanism is too large to pass through the central opening;

means for coupling said connector mechanism with said undamaged flange in extension therefrom whereby said connector mechanism may be inserted through the opening of the damaged flange to position the damaged and undamaged flanges in proximity to one another; and means operable from the side of said undamaged flange remote from the damaged flange to effect movement of said connector mechanism from the contracted position to the expanded position.

6. A device as set forth in claim 5, wherein said connector mechanism is constructed in a manner to move by toggle action between the contracted and expanded positions.

7. A toggle mechanism for connecting a first flange member to a second flange member having an opening therein and an inaccessible surface surrounding the opening, said toggle mechanism comprising:

a connector head movable by toggle action between a contracted position wherein said head is small enough to pass through the opening of the second member and an expanded position wherein said head is too large to pass through said opening;

a spacer element connected with said connector head and adapted to be interposed between the first and second members to space same apart from one another;

means for mounting said connector head to the first member with the head projecting therefrom to permit insertion of said head through said opening of the second member with said spacer element interposed between the first and second members; and actuating means operable from a side of said first member remote from the second member to effect movement of the connector head from the contracted to the expanded position, said connector head including a toggle linkage having a pair of levers each having an end which is drawn by toggle action firmly against said inaccessible surface of the second member upon movement of said connector head to the expanded position, whereby said ends of the levers contact said inaccessible surface to connect the first member to the second member with said spacer element interposed closely between the first and second members in engagement with each.

* * * * *